US006725574B2

(12) United States Patent
Hokkirigawa et al.

(10) Patent No.: US 6,725,574 B2
(45) Date of Patent: Apr. 27, 2004

(54) SHOE MIDSOLE, METHOD FOR PREPARING SAME AND SHOES USING SAME

(75) Inventors: Kazuo Hokkirigawa, Yonezawa (JP); Motoharu Akiyama, Nagano-ken (JP); Noriyuki Yoshimura, Nagano-ken (JP)

(73) Assignee: Minebea Co., Ltd., Nagano-ken (JP)

( * ) Notice: Subject to any disclaimer, the term of this patent is extended or adjusted under 35 U.S.C. 154(b) by 86 days.

(21) Appl. No.: 10/134,268

(22) Filed: Apr. 29, 2002

(65) Prior Publication Data

US 2002/0162247 A1 Nov. 7, 2002

(30) Foreign Application Priority Data

May 1, 2001 (JP) ..... 2001-134699

(51) Int. Cl.[7] ..... A43B 13/12; A43B 23/00

(52) U.S. Cl. ..... 36/30 R; 36/25 R; 36/85; 36/107

(58) Field of Search ..... 36/25 R, 30 R, 36/85, 87, 103, 107

(56) References Cited

U.S. PATENT DOCUMENTS 4,962,555 A * 10/1990 Nakamura ..... 12/147 R
6,006,450 A * 12/1999 Hayes ..... 36/107
6,209,228 B1 * 4/2001 Yang ..... 36/44
6,425,193 B2 * 7/2002 Vaz ..... 36/30 R

OTHER PUBLICATIONS

Article: *Development of Hard and Porous Carbon Material "RB Ceramics" Using Rice Bran as a Starting Material*; (Translation from "Zairyou Kagaku", vol. 17, No. 6, pp. 24 to 27, May 1997); Kazuo Hokkirigawa; 10 pages.

* cited by examiner

*Primary Examiner*—M. D. Patterson
(74) *Attorney, Agent, or Firm*—Flynn, Thiel, Boutell & Tanis, P.C.

(57) ABSTRACT

There are provided a shoe midsole which is light in weight, long life, excellently abrasion resistant, sufficiently air-permeable and well-workable, and shoes using same. The shoe midsole in the form of footprint plate comprising a light metallic skeleton in the form of footprint plate and RB ceramics or CRB ceramics molded around the skeleton.

10 Claims, 3 Drawing Sheets

SHOE MIDSOLE, METHOD FOR PREPARING SAME AND SHOES USING SAME

BACKGROUND OF THE INVENTION

1. Field of the Invention

This invention relates to a shoe midsole and shoes using same by the use of an advanced material having high environmental adaptability obtained from biomass resources, which is a new ecological product of high technology and is different from conventional industrial materials.

2. Prior Art

Hide, soft or hard rubber and high molecular resins have been mainly used as a conventional shoe midsole, although each of these material confronts a problem respectively Requirements of such a shoe sole are fastness, lightness, low wearability, resistance to temperatures, easy workability, low cost, etc.

There is no conventional material as described above which meets all of these requirements.

For example, hide is one of the best materials as a shoe midsole which looks high-grade, easily fits feet and is flexible, however, it tends to be affected by humidity and is not enough abrasion-resistant.

Soft or hard rubber is little affected by humidity although it does not look so high-grade, but is relatively heavy as a material, which is a problem for weight-saving.

On the other hand, a high molecular resin material is sufficiently flexible, little affected by humidity and appropriately abrasion-resistant, but does not look high-grade.

SUMMARY OF THE INVENTION

Accordingly, it is an object of the present invention to provide a shoe midsole and shoes using same in which disadvantages of conventional shoe midsole are overcome to yield a light in weight and long-life material of less sensitive to scratching, less influenceable to humidity, improved abrasion-resistance, air-permeability and workability.

According to the present invention, RB ceramics and CRB ceramics are used as a shoe midsole, which are very light in weight, hard and fast material of good abrasion-resistance, high moisture-absorbing properties and improved air-permeability. The RB and CRB ceramics are those materials prepared by the following method.

As is known, Kazuo Horikirigawa, the first inventor of the present invention has investigated and developed a porous carbon material by the use of rice bran (see, Kinou Zairyou Vol. 17, No. 5 pp. May 24 to 28, 1997). Rice bran is by-produced 900.000 ton/year in Japan or 33 million ton/year in the world.

The above mentioned literature describes a carbon material (hereinafter referred to as RB ceramics) and its method of preparation, in which a defatted product of rice bran and a thermosetting resin are mixed, kneaded and press-molded to form a molded material, followed by drying and baking the dried material in an atmosphere of inert gas.

According to the this method, degree of shrinkage between size of the press molded material and that of the material calcined in an inert gas reached almost 25%, which made it substantially difficult to form a precision molded material and finally has been improved by developing novel ceramics (hereinafter referred to as CRB ceramics).

CRB ceramics is an improved material of RB ceramics obtained from defatted rice bran and a thermosetting resin. CRB ceramics is a black resinous and porous ceramics prepared by mixing and kneading a defatted product of rice bran and a thermosetting resin and primarily baking a mixture thus obtained in an inert gas at 700 to 1,000° C., followed by grinding to form carbonated powder of about 60 mesh or less, which is then mixed and kneaded with the thermosetting resin, press-molded at pressure of 20 Mp to 50 Mp and then heat-treated again in an atmosphere of inert gas at 100 to 1,100° C. The most distinguished point of these two kinds of ceramics is that degree of shrinkage between size of the molded RB ceramics and that of the final product is almost 25%, while the degree is as advantageously small as 3% or less in the case of CRB ceramics.

DETAILED DESCRIPTION

Figure 1:
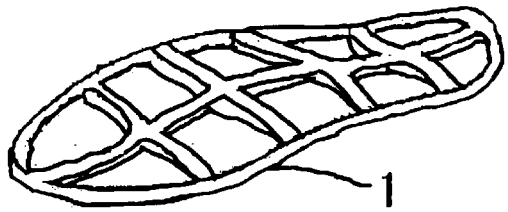
FIG. 1 is a perspective view of a skeleton of shoe midsole according to the present invention.

According to the present invention, light in weight and hard RB ceramics or CRB ceramics, a novel ceramic material, is used as a shoe midsole. Both of these materials are an environmentally adaptable ceramic material having various excellent properties. General properties of RB and CRB ceramics materials are as in the following:

extremely high hardness;

very small expansion coefficient;

porous structure;

electrical conductivity, low specific gravity or lightness;

improved abrasion resistance;

easiness of molding and mold making;

low degree of shrinkage between size of the molded material and the final product (only in the case of CRB ceramics);

possibility to form a variety of characteristic ceramics depending on formulation of various resins; and less negative effects to global environment and more resource conservation due to rice bran to be used as a starting material.

As described above, these ceramic materials meet requirements suitable for applying them to a shoe midsole, such as lightness, improved abrasion resistance, less sensitiveness to scratching, porous structure and high air-permeability, and long life. Especially, CRB ceramics obtained by a secondary heat treatment at 600° C. or more is an excellent material as a shoe midsole because of extreme hardness, porosity, improved air-permeability and low specific gravity or lightness.

The inventors have found that a shoe midsole of a variety of properties can be easily made by applying CRB ceramics to at least a part of the midsole. Although degree of shrinkage between size of the molded material and that of the final one is almost 25% in the case of conventional RB ceramics, RB ceramic should no be excluded from embodiments of the present invention because the size is adjusted by trimming an as made shoe midsole of RB ceramics in an embodiment thereof. Properties of RB ceramics and CRB ceramics are about the same except the trim size, and also from this point of view, RB ceramics may be included in the embodiments of the present invention.

However, CRB ceramics is preferably used for the most part in the present invention because a product of high dimensional accuracy can be obtained by one step molding. It has also been found that a shoe midsole of various properties can be made by properly combining with a conventional midsole material made of synthetic resins or steely metals and, at the same time, devising a shape of contacting part to such a conventional material.

Accordingly, the present invention provides a shoe midsole comprising RB ceramics or CRB ceramics as a whole or at least a part thereof

THE PREFERRED EMBODIMENTS

A RB ceramics or CRB ceramics material used for a shoe midsole of the present invention is prepared from a defatted product of rice bran as the main raw material and a thermosetting resin.

The defatted rice bran is not limited to a specific species of rice and may either be Japanese or foreign one.

The thermosetting resin may be any resin which can be thermally set and typically includes phenol-, diarylphthalate-, unsaturated polyester-, epoxy-, polyimide- and triazine resins, although a phenol resin is preferably used A thermoplastic resin such as polyamide may be used together without departing from a scope of the present invention.

A mixing ratio of the defatted rice bran and the thermosetting resin is in the range of 50 to 90:50 to 10 and preferably 70 to 80:30 to 20 in weight ratio.

A method for preparing a RB ceramics material is known from a literature reported by Kazuo Horikirikawa, the first inventor of the present invention (see, Kinou Zairyou Vol. 17, No. 5, pp. May, 245 to 28, 1997).

According to the literature, there are provided a carbon material and a method for preparing it, in which a defatted product of rice bran and a thermosetting resin are mixed, kneaded and press-molded to form a molded material, followed by drying and baking the dried material in an atmosphere of inert gas.

The CRB ceramics material useful for the present invention will be briefly described in the following. A defatted product of rice bran and a thermosetting resin are mixed and kneaded, and then primarily calcined in an inert gas at 700 to 1,000° C., followed by grinding to form carbonated powder, which is then mixed and kneaded with the thermosetting resin, press-molded at pressure of 20 Mp to 50 Mp and heat-treated again in an atmosphere of inert gas at 100 to 1,100° C.

The CRB ceramics material used in the present invention is preferably heat treated in specialty at a temperature of 400 to 1,100° C., because the thus heat treated material has high air-permeability.

The thermosetting resin to be primarily calcined is desirably liquid of relatively low molecular weight.

In general, primary baking is conducted by means of a rotary kiln for about 40 to 120 minutes. A mixing rate of carbonized powder obtained by the primary baking and a thermosetting resin is in the range of 50 to 90:50 to 10, and preferably 70 to 80: 30 to 20 by weight, respectively.

A pressure for press molding a kneaded mixture of the carbonized powder and the thermosetting resin is in the range of 20 to 50 Mp, and preferably 22 to 35 Mp. The mold temperature is preferably 150° C.

The heat treatment is generally conducted by means of a well-controlled electric furnace for about 60 to 360 minutes.

A preferable heat treatment temperature is 600 to 1,1000° C., while a heating rate up to the heat treatment temperature, especially up to 500° C., should be relatively slow, and in concrete terms, 0.5 to 5° C. per minute, preferably 0.5 to 2° C. and more preferably about 1° C. per minute.

Further, it is necessary to lower the temperature relatively slowly down to 500° C., after the heat treatment is completed, followed by spontaneous heat dissipation under 500° C. In concrete terms, such a slow down rate is 0.5 to 5° C. per minute and preferably about 1° C. per minute.

An inert gas used for the primary baking and the heat treatment may include either one of helium, argon, neon, nitrogen gas, etc., although nitrogen gas is preferable.

Desirably, the RB ceramics or CRB ceramics used in the present invention is dehydrated at a temperature of 100° C. or upper after molding.

In a shoe midsole of the present invention and shoes using same, there is characteristically used a shoe midsole in the form of footprint plate which comprises a skeleton in the form of footprint plate made of light metal as shown in FIG. 1 and RB ceramics or CRB ceramics molded around the skeleton. The shoe midsole may be used by a combination of other widely used conventional midsole materials such as rubber, synthetic resins and hide, which are used as shoe materials other than the midsole.

Such synthetic resins may include any of polyurethane, polyolefin, polyamide, polyacetal, vinylon, soft or hard rubber, etc.

Light metals for the skeleton in the form of footprint plate include aluminum, aluminum alloys such as duralumin, Almite, metallic titanium, etc., although aluminum, Almite and duralumin are preferable from a practical viewpoint.

The shoe midsole of the present invention may be shaped into various configurations depending on a use thereof, such as a plate-like type of fixed sole thickness or a tapered type which sole is thickened toward a heel portion.

Figure 2:
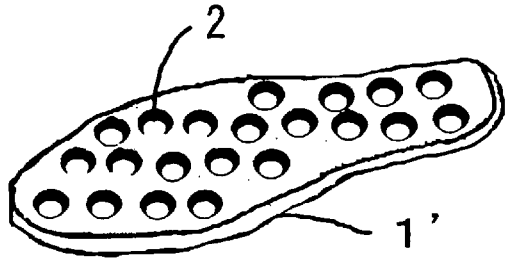
FIG. 2 is a perspective view of a skeleton of shoe midsole according to the present invention.

The light-metallic footprint plate may be bored to form holes 2 for the purpose of increasing stiffness and weigh saving as shown in FIG. 2. These holes 2 may be any shape such as circle, quadrilateral, honeycomb structure, etc., although the honeycomb structure is the lightest and strongest shape.

It is necessary to take size and arrangement of holes 2 into consideration so as not to loose the touch of foot.

The shoe midsole of the present invention may paste with an outsole made of rubber or other materials on a grounding surface side thereof to make shoes.

Further, the shoe midsole of the present invention may paste with a sheet material such as rubber, synthetic resins and hide on a surface side thereof facing to the foot sole to make shoes. In particular, an electrically conductive sheet is conveniently used for the purpose of making antistatic shoes. Any known conductive sheet may be used in this case.

The shoe midsole of the present invention may be effectively applied to any kind of shoes such as sneaker, men's and women's shoes, high-heel shoes, sports shoes and golf shoes.

The preferred embodiments of the present invention will be summarized as in the following.

1. A shoe midsole in the form of footprint plate comprising a light metallic skeleton in the form of footprint plate and RB ceramics or CRB ceramics molded around the skeleton
2. The shoe midsole in a plate form described in the above item 1 in which a light metallic skeleton in the form of footprint plate is a plate sloped in the upward direction from a toe to a heel.
3. A shoe midsole in the form of footprint plate comprising a bored light metallic skeleton in the form of footprint plate and RB ceramics or CRB ceramics molded thereon.
4. The shoe midsole described in the above item 3 in which a shape of bored holes is circle or quadrilateral.
5. The shoe midsole described in the above item 3 in which quadrilateral is honeycomb structure.
6. The shoe midsole described in the above items 1 to 5 in which light metal is a metallic material selected from aluminum, Almite and duralumin.
7. A method for preparing a shoe midsole which comprises putting a light metallic skeleton in the form of footprint plate in a mold, charging a precursor of RB ceramics or CRB ceramics thereon to mold at a pressure of 20 to 50 Mpa and taking out the thus molded product from the mold to subject to a heat treatment in an atmosphere of inert gas at 400 to 1,100° C. followed by cooling.
8. The method for preparing a shoe midsole described in the above item 7 in which a mold temperature is 100 to 300° C.
9. The method for preparing a shoe midsole described in the above item 7 or 8 in which a heating rate is 5° C. per minute or less up to 500° C. as a temperature of a molded product, while a cooling rate is 5° C. per minute or less down to 500° C. as a temperature of the molded product.
10. Women's high heel shoes in which a shoe midsole described in any one of the above item 1 to 6 is applied.
11. Men's shoes in which a shoe midsole described in any one of the above item 1 to 6 is applied.
12. Antistatic shoes in which a shoe midsole described in any one of the above item 1 to 6 is applied together with a heel part molded by an electrically conductive rubber or resins.
13. The antistatic shoes described in the above item 12 in which a surface facing to a foot sole is covered by an electrically conductive sheet.

A shoe midsole of the present invention and shoes using same are less sensitive to scratching, light in weight, long life, excellently abrasion resistant, seldom affected by the change in temperature and easily workable, which properties exhibit conventionally unexpected effects.

In particular, a shoe midsole formed by CRB ceramics can be integrally molded with a heel part, which allows to make shoes easily and accurately due to lower degree of shrinkage between a molded size and final one and exhibits electrostatic properties when the CRB ceramics is treated at a secondary heat treatment temperature of 600° C. or more.

A shoe midsole of the present invention will be described in the following examples.

EXAMPLE 1

An example of a shoe midsole of the present invention is shown in FIG. 1.

A shoe midsole made of CRB ceramics is prerepared as in the following.

Preparation of a CRB Ceramics Precursor

A defatted product of rice bran in an amount of 75 kg and a liquid phenol resin (resol) in an amount of 25 kg were mixed and kneaded by heating at 50 to 60° C. to form a plastic and homogeneous mixture.

The mixture was primarily calcined in a nitrogen atmosphere at 900° C. for 60 minutes by means of a rotary kiln. The carbonated material thus calcined was screened through a 100 mesh screen to obtain a carbonated powder having particle size of 50 to 250 $\mu$m.

The carbonated powder thus obtained in an amount of 75 kg and a solid phenol resin (resol) in an amount of 25 kg were mixed and kneaded by heating at 100 to 150° C. to form a plasticized CRB ceramics precursor as a plastic homogenized mixture.

Molding of a Shoe Midsole

An Almite skeleton 1 in the form of footprint plate as shown in FIG. 1 was put in a mold, while the plasticized CRB ceramics precursor was charged therein to press mold at a pressure of 22 Mpa at a mold temperature of 150° C.

The molded part was took out of the mold and subjected to heat treatments by heating at a heating rate of 1° C. per minute up to 500° C., keeping at 500° C. for 60 minutes, heating at a heating rate of 2° C. per minute and then at 900° C. for about 120 minutes, respectively in nitrogen atmosphere.

Figure 3:
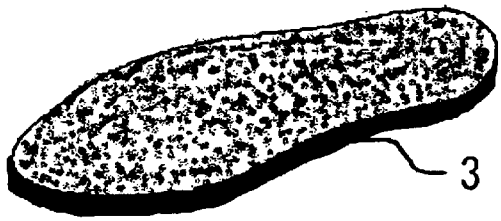
FIG. 3 is a perspective view of a shoe midsole after molding according to the present invention.

After that, the heat treated material was cooled at a cooling rate of 2 to 3° C. per minute down to 500° C. and then allowed to spontaneously cool at a temperature lower than 500° C. to form a molded part 3 of CRB ceramics as shown in FIG. 3.

As the molded part 3 is usually bored by a drill to form thread eyelets along a peripheral portion thereof in the course of shoe making, it is convenient to bore such eyelets in advance. Further, they may play a role of decorative stitching when shoes are made without using thread but an adhesive.

Characteristic features of a shoe midsole 1 shown in FIG. 3 are as follows:

weight saving of the shoe midsole due to lower specific gravity;

improved air-permeability due to porosity, and usefulness of the shoe midsole as an electrically conductive material.

EXAMPLE 2

Preparation of a CRB Ceramics Precursor

A defatted product of rice bran in an amount of 75 kg and a liquid phenol resin (resol) in an amount of 25 kg were mixed and kneaded by heating at 50 to 60° C. to form a plastic and homogeneous mixture.

The mixture was primarily calcined in a nitrogen atmosphere at 900° C. for 60 minutes by means of a rotary kiln. The carbonated material thus calcined was screened through a 100 mesh screen to obtain a carbonated powder having particle size of 50 to 250 μm.

The carbonated powder thus obtained in an amount of 75 kg and a solid phenol resin (resol) in an amount of 25 kg were mixed and kneaded by heating at 100 to 150° C. to form a plasticized CRB ceramics precursor as a plastic homogenized mixture.

Molding of a Shoe Midsole

Figure 4:
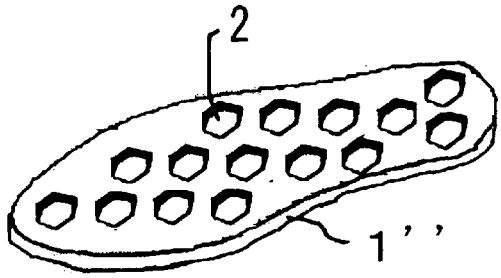
FIG. 4 is a perspective view of a skeleton of shoe midsole according to the present invention.

An Almite skeleton 1' in the form of footprint plate having holes 2 as shown in FIG. 4 was put in a mold, while the plasticized CRB ceramics precursor was charged therein to press mold at a pressure of 22 Mpa at a mold temperature of 150° C.

The molded part was took out of the mold, subjected to heat treatments by heating at a heating rate of 1° C. per minute up to 250° C. and keeping at 250° C. for about 120 minutes and then spontaneously cooled to form a molded part.

Characteristic features of a shoe midsole 1 obtained in Example 2 are as follows.

The shoe midsole was materially tough in full, fast, thin and firm, with the exception of lesser porosity compared with Example 1.

EXAMPLE 3

Preparation of a RB Ceramics Precursor

A defatted product of rice bran in an amount of 75 kg and a liquid phenol resin (resol) in an amount of 25 kg were mixed and kneaded by heating at 50 to 60° C. to form a RB ceramics precursor as a plastic and homogeneous mixture.

Molding of a Shoe Midsole

An Almite skeleton 1" in the form of footprint plate having holes 2 as shown in FIG. 4 was put in a mold, while the plasticized RB ceramics precursor was charged therein to press mold at a pressure of 30 Mpa at a mold temperature of 150° C.

The molded part was took out of the mold and subjected to heat treatments by heating at a heating rate of 1° C. per minute up to 500° C., then at a heating rate of 2° C. per minute, and further at 700° C. for about 120 minutes, respectively in nitrogen atmosphere, followed by spontaneous cooling to form a molded and heat treated part.

Characteristic features of a shoe midsole 1 shown in FIG. 3 are as follows.

RB ceramics was materially almost similar to CRB ceramics except insufficient molding properties. A slightly larger footprint plate was made and trimmed manually by means of a sandpaper to shape into a desired form.

EXAMPLE 4

Preparation of Women's High Heel Shoe

Figure 5:
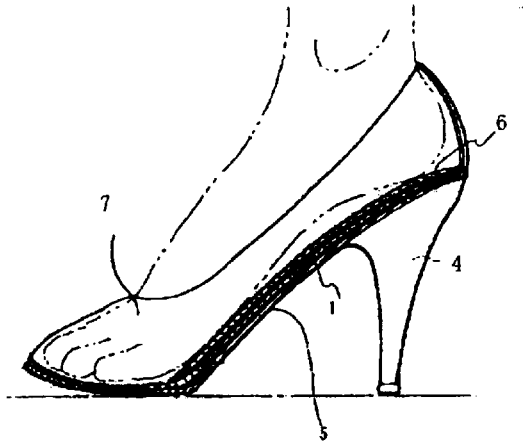
FIG. 5 is a perspective view of an example of a high heel shoe using a shoe midsole according to the present invention.

In FIG. 5, there is shown an example of a high heel shoe using a shoe midsole of the present invention.

CRB ceramics of Example 1 is used as the shoe midsole 1, which pastes with a hard rubber shoe sole 5 on a grounding surface side thereof by means of an adhesive as shown in FIG. 5. Further, a heel part 4 pastes with an end part of the shoe midsole 1 by means of an adhesive.

The shoe midsole 1 pastes with a synthetic leather backer (or a sheet facing to a foot sole) on a surface thereof faced to a foot sole thereof by means of an adhesive. Numeral 7 designates a vamp of tanned cow hide.

Characteristic features of the shoe midsole shown in FIG. 5 are as follows:

weight saving of the shoe midsole due to lower specific gravity, which makes the shoe light in weight; and improved air-permeability due to porosity

EXAMPLE 5

Preparation of Men's Shoe

Figure 6:
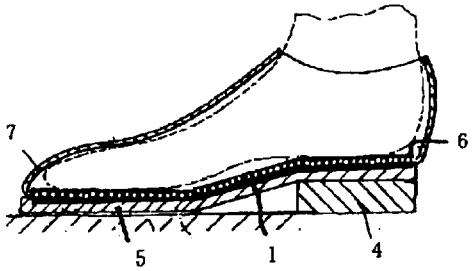
FIG. 6 is a perspective view of an example of men's shoe using a shoe midsole according to the present invention.

In FIG. 6, there is shown an example of men's shoe using a shoe midsole of the present invention.

RB ceramics of Example 3 is used as the shoe midsole 1, which pastes with a hard rubber heel part 4 on an end part thereof by means of an adhesive. The heel part 4 may be molded integrally with the shoe midsolel. Numeral 7 designates a vamp of tanned cow hide.

Characteristic features of the shoe midsole shown in FIG. 6 are as follows:

weight saving of the shoe midsole due to lower specific gravity; and improved air-permeability due to porosity

EXAMPLE 6

Preparation of an Electrostatic Shoe

A shoe midsole of the present invention is basically light in weight, hard and excellently abrasion resistant, while, in particular, CRB ceramics subjected to the secondary heat treatment at a temperature of 600° C. or more is quite electrically conductive and useful for making electrostatic shoes.

Figure 7:
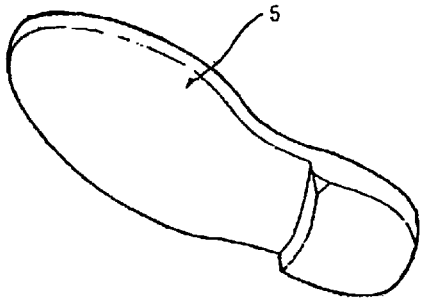
FIG. 7 is a perspective view of men's shoe outsole.

A shoe sole shown in FIG. 7 comprises electrically conductive rubber, which is quite electrically conductive from a tip part to a heel part.

An electrostatic shoe was made using the above mentioned shoe sole, the shoe midsole of Example 1, a backer (a sheet facing to a foot sole) and an electrically conductive rubber sheet.

The electrically conductive sheet used herein includes a resin or rubber sheet formulated with an electrically conductive powder such as carbon, respectively, leather treated by an electrically conductive agent, etc.

Figure 8:
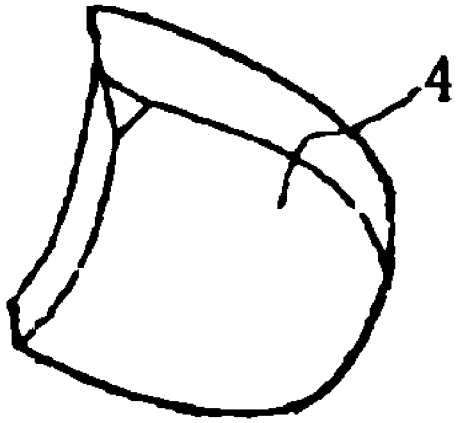
FIG. 8 is a perspective view of a heel part of men's shoe.

A heel part shown in FIG. 8 was prepared from electrically conductive hard rubber and used to make an electrostatic shoe by a combination of a shoe midsole arranged under a foot sole and a surface faced thereto in which an electrically conductive rubber sheet was partially used.

What is claimed is:

1. A shoe midsole (1) in the form of footprint plate comprising a light metallic skeleton in the form of footprint plate and RB ceramics or CRB ceramics molded around the skeleton.

2. The shoe midsole in a plate form claimed in claim 1 in which a light metallic skeleton in the form of footprint plate is a plate sloped in the upward direction from a toe to a heel.

3. The shoe midsole claimed in claim 1 in which light metal is a metallic material selected from aluminum, Almite and duralumin.

4. Women's high heel shoes in which a shoe midsole claimed in claim 1 is applied.

5. Men's shoes in which a shoe midsole claimed in claim 1 is applied.

6. Antistatic shoes in which a shoe midsole claimed in claim 1 is applied together with a heel part molded by an electrically conductive rubber or resins.

7. The antistatic shoes claimed in claim 6 in which a surface facing to a foot sole
is covered by an electrically conductive sheet.

8. A shoe midsole in the form of footprint plate comprising a bored light metallic skeleton in the form of footprint plate and RB ceramics or CRB ceramics molded thereon.

9. The shoe midsole claimed in claim 8 in which a shape of bored holes is circle or quadrilateral.

10. The shoe midsole claimed in claim 8 in which quadrilateral is honeycomb structure.

* * * * *